US006009729A

United States Patent [19]

Halassek

[11] Patent Number: 6,009,729

[45] Date of Patent: Jan. 4, 2000

[54] PROCESS FOR A KNITTING MACHINE EMPLOYING THREAD PROCESSING ELEMENTS EMBEDDED IN CARRIER

[75] Inventor: Josef Halassek, Obertshausen, Germany

[73] Assignee: Karl Mayer Textilmachinenfabrik GmbH, Germany

[21] Appl. No.: 09/191,465

[22] Filed: Nov. 12, 1998

Related U.S. Application Data

[62] Division of application No. 08/847,050, May 1, 1997.

[30] Foreign Application Priority Data

May 8, 1996 [DE] Germany ..... 196 18 368

[51] Int. Cl.[7] ..... D04B 27/24

[52] U.S. Cl. ..... 66/214; 156/253; 112/80.45

[58] Field of Search ..... 156/253, 297, 156/298, 300; 66/214, 87, 114, 208; 139/192; 112/80.45

[56] References Cited

U.S. PATENT DOCUMENTS

| | | | |
|---|---|---|---|
| 3,369,379 | 2/1968 | Shepard . | |
| 3,746,053 | 7/1973 | Crain | 139/192 |
| 3,965,940 | 6/1976 | Marty | 139/192 |

FOREIGN PATENT DOCUMENTS

| | | | |
|---|---|---|---|
| 2112122 | 3/1973 | Germany . | |
| 40 33 262 | 4/1992 | Germany | 66/214 |
| 4438061 | 12/1995 | Germany . | |

OTHER PUBLICATIONS

European Search Report, EP 97 10 7144; Oct. 14, 1998.

*Primary Examiner*—Andy Falik
*Attorney, Agent, or Firm*—Omri M. Behr, Esq.

[57] ABSTRACT

A process can form an arrangement for a warp knitting or circular knitting machine with (a) a single hardenable retaining material, (b) a plurality of thread processing elements having proximal ends, and (c) a carrier having a face with a groove. The process includes the step of introducing the hardenable retaining material before it is hardened into the groove of the carrier. The process also includes the step of holding the thread processing elements in a single plane. Another step is introducing the proximal ends of the thread processing elements into the non-hardened retaining material, keeping the thread processing elements in a single plane with even separation while protruding from the face of the carrier. The process also includes the step of waiting for hardening of said retaining material, wherein the proximal ends are embedded in the carrier.

4 Claims, 1 Drawing Sheet

PROCESS FOR A KNITTING MACHINE EMPLOYING THREAD PROCESSING ELEMENTS EMBEDDED IN CARRIER

This Application is a Division of Ser. No. 08/847,050 filed May 1, 1997.

BACKGROUND OF THE INVENTION

1. Field of the Invention

The present invention is related to process for forming arrangements with thread guide elements of a warp or circular knitting machine and a carrier in which the thread guide elements have the same separation from each other and lie in a common plane, protruding from the face of the carrier with each having a proximal end embedded in a composition in the carrier to hold them in place.

Under the term thread guide elements one includes thread guide needles, sliders for needles or sinkers.

2. Description of Related Art

In a well known arrangement of the prior art, thread processing elements such as thread guides, slider needles, sinkers and the like are fused into a carrier made of a zinc antimony alloy. In the formation of such an arrangement (which is commonly known as a "thread guide lead"), the guides are held in place by a tool and placed in a mold comprising an upper and a lower portion into which the alloy is poured. This production procedure is unsuitable for automated serial production, since the pouring and forming is time consuming. Also, in practice, it has not been possible to achieve a high level of production by providing a plurality of identically formed molds in which, at the same time, a plurality of "guide leads" can be produced, which are exactly the same. Furthermore, after the solidification of the carrier material, time consuming position correction of the thread guides is necessary, since during the hardening process their positions may alter and at least the separation of the eyelet end segments which protrude from the carrier must have a pre-determined measurement.

The same difficulties arise when guides with unpenetrated end segments are molded into a synthetic carrier material.

German patent DE-PS 870 591 discloses a carrier wherein the feet of the needles are first embedded in lead and thereafter, embedded in a synthetic material. The positioning of the feet embedded in lead is secured by protuberances or "indentations". However, lead is too heavy for this purpose.

German patent DE-PS 911 772 discloses a situation wherein the needles are only embedded in a synthetic material and secured therein by portions core. There is no disclosure herein of a groove for all needles.

A situation similar to that of DE-PS 870 591 is disclosed in British Patent 1 225 935 wherein the body of the holder is made of a plastics material and the needles are embedded in a lead mounted strip. Again, the use of lead under these circumstances is no longer considered acceptable practice.

German OLS 2 110 420 discloses a carrier wherein there are provided individual grooves for each thread guide. While the principle invention is directed to the exact fitting of the thread guides into the grooves, in a further embodiment the grooves are oversized and then, after introduction of the thread guides, filled with a hardening material which could be metallic, epoxy resin or the like. The provision of vertical grooves in this manner is far more complex and time consuming than the provision of a single groove.

German OLS DE 40 33 262 discloses a device wherein the needles or the like are embedded in a carrier of synthetic material which is then introduced into a groove of a holder. The synthetic material is then locked into the holder, either by heating to provide a minimal amount of melting, or by introduction of a solvent which has a similar effect in order to lock the carrier of synthetic material to the holder.

Accordingly, an object of the present invention is to provide an arrangement of a type known by the prior art, but whose structure and mode of production is improved and simpler, and wherein the final correction step of the thread guide elements may be omitted.

SUMMARY OF THE INVENTION

In accordance with the illustrative embodiments demonstrating features and advantages of the present invention, a process is provided. The process employs (a) a hardenable retaining material, (b) a plurality of thread processing elements having proximal ends, and (c) a carrier having a face with a groove. The process includes the step of introducing the hardenable retaining material into the groove of the carrier. Another step is holding the thread processing elements in a single plane. The process also includes the step of introducing the proximal ends of the thread processing elements into the retaining material, keeping the thread processing elements in a single plane with even separation while protruding from the face of the carrier. Also included is the step of waiting for hardening of the retaining material, wherein the proximal ends are embedded in the carrier.

In accordance with preferred embodiments of the present invention the front face of a carrier has a groove for holding the proximal ends of thread processing elements, such as thread guides, slider needles, sinkers and the like. These elements are integrally combined with the carrier by being embedded in a solidifiable material.

As retaining material, there may be utilized synthetic materials, in particular, curable polymeric resins.

In this preferred procedure, the groove of the previously prepared carrier can be provided with the retaining material and then by means of an appropriate tool, the thread guiding elements are introduced into the retaining material. The thread guiding elements are held there by said tool until the retaining material has hardened so that the proximal ends of the thread guiding elements are completely encapsulated therein. Since it is possible to utilize a comparatively small amount of retaining material, the position of the thread guide elements even after hardening is substantially unchanged, particularly when one utilizes a cold or relatively low temperature (i.e. up to 85° C.) curing resin.

The carrier may be made of a lightweight metal which can, for example, contain aluminum. Suitably, there is utilized a aluminum magnesium alloy.

Such a carrier has a relatively low weight and because of its low mass facilitates a high working speed of the thread guiding elements.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention, when taken in conjunction with the accompanying drawings, wherein.

DETAILED DESCRIPTION OF THE PREFERRED EMBODIMENTS

Figure 2:
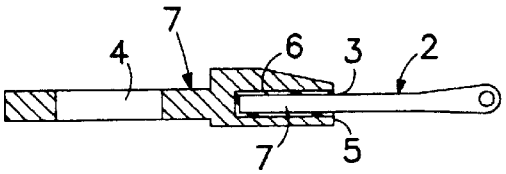
FIG. 2 is a cross sectional view taken along line II—II of FIG. 1.
Figure 3:
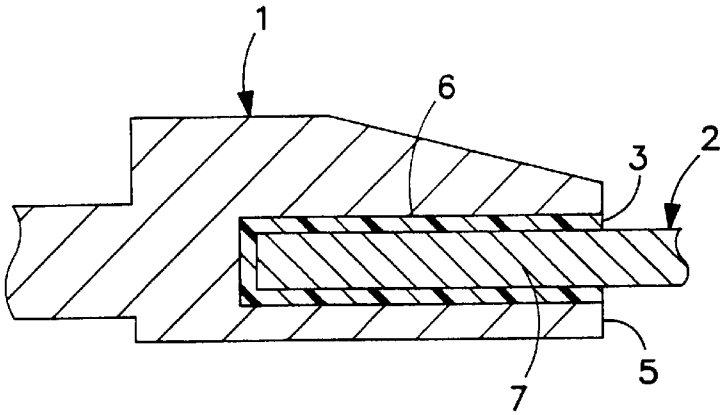
FIG. 3 is an enlarged view of the cross section of FIG. 2.
Figure 1:
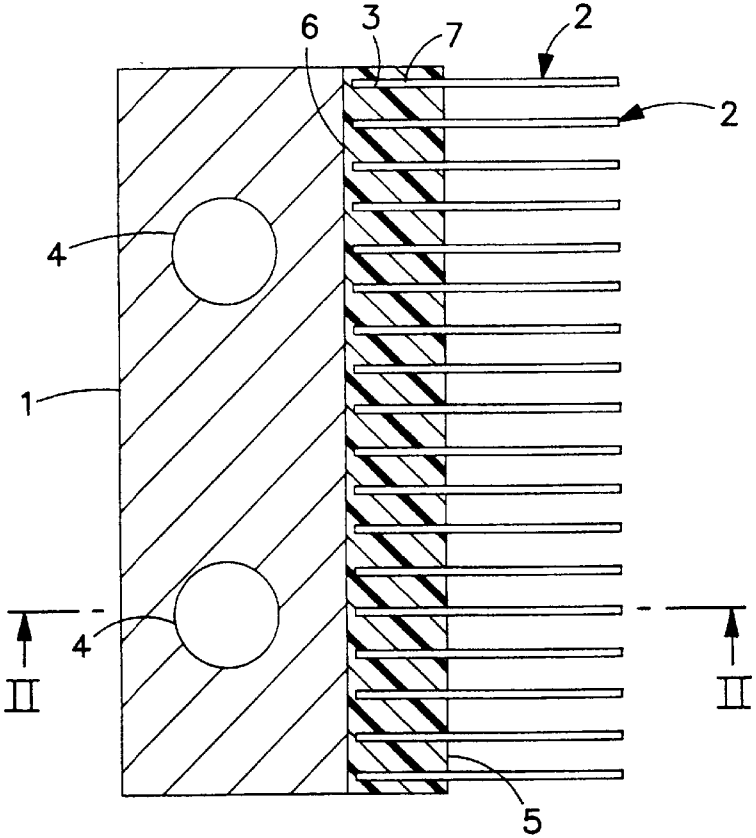
FIG. 1 is a cross sectional view of an arrangement according to the principles of the present invention, viewed parallel to the plane containing the guide elements lie and shown in a size ratio of 2 to 1.

A preferred arrangement of the present invention comprises, as illustrated, thread processing elements 2 in the form of thread guides for a warp knitting machine and a solidifiable retaining material 3 in the form of hardenable resin, suitably, a two component material comprising, for example, an epoxy resin and a hardener. Especially suitable are epoxy resins with amine hardeners such as Scotch-Weld Duo-Pak, DP 410 (manufactured by 3M corporation, Minneapolis, Minn.) and Technicoll 8256/8259 (manufactured by HB Fuller GmbH, Munich, Germany). Such resins will set at room temperature and are temperature stable after setting at least up to 200° C. The setting process may be accelerated by heating; however, in order to maintain the integrity of the metal carrier, the cure temperature should not exceed 85° C. With respect to the retaining material one can also use a thermoplastic synthetic material.

The carrier 1 comprises a light metal, suitably comprising aluminum, in particular, an aluminum magnesium alloy; most suitably, $AlMg_3Zn$. In carrier 1 the holes 4 serve for affixing said carrier to a bar with screws. In face 5 of carrier 1, there is provided a groove 6 which runs across its entire breadth and is open at its ends. The carrier 1 is formed by extrusion and then is provided with the holes 4 and the groove; wherein, the groove 6 in the front face 5 is milled out. Thereafter, the carrier 1 is placed in a suitable holder or mold to close off the ends of the groove 6 before the retaining material 3 is introduced into the groove 6 in unhardened form. Thereafter, the guide elements 2 are introduced into groove 6 by means of a tool (e.g., a clamping fixture) carrying the guide elements 6 so that the proximal ends 7 thereof extend nearly to the base of the groove in such a manner that they do not touch the parallel side walls of the groove and so that the proximal ends 7 are embedded into the retaining material 3. The separation of the thread guiding elements 2 from the side walls of the groove 6 should be sufficient so that there is sufficient space to fill it with the filling material 3 and to obtain a complete connection between the thread guide elements 2 and the carrier 1. In the illustrated example this separation is of the order of 0.15 to 1 mm, particularly 0.19 mm.

The formation of the carrier 1 and its combination with the thread guide elements 2 permits an automatic serial production of the entire arrangement without the need to readjust the position of the thread guide elements 2 after hardening of the retaining material 3. The arrangement is furthermore light and enables the use of higher working speeds.

Alternatively the carrier 1 can be made of a synthetic material; suitably, out of a composite of a high temperature stable resistant thermoplastic material comprising a retaining. Especially suitable for injection molding procedures is a partially crystalline polyphenyl sulphide/glass fiber/mineral retaining material such as, Albis Tedur L-9523 (manufactured by Albis Plastic GmbH, Hamburg, Germany).

I claim:

1. Process for forming an arrangement for a warp knitting or circular knitting machine with (a) a single hardenable retaining material, (b) a plurality of thread processing elements having proximal ends, and (c) a carrier having a face with a single groove, comprising the steps of:

introducing the hardenable retaining material before it is hardened into the groove of the carrier;

holding the thread processing elements in a single plane;

introducing the proximal ends of the thread processing elements into the non-hardened retaining material, keeping the thread processing elements in a single plane with even separation while protruding from the face of the carrier; and waiting for hardening of said retaining material, wherein the proximal ends are embedded in the carrier.

2. Process in accordance with claim 1 wherein the groove in the carrier has a base and a pair of side walls, and wherein the step of introducing the proximal ends of the thread processing elements into the retaining material is performed by bringing the thread processing elements near the base of the groove without contacting the side walls of said groove.

3. Process in accordance with claim 1 wherein the groove in the carrier has a base and a pair of side walls, and wherein the step of introducing the proximal ends of the thread processing elements into the retaining material is performed by bringing the thread processing elements near the base of the groove without contacting the base and the side walls of said groove.

4. Process in accordance with claim 1 wherein said single groove extends longitudinally in said carrier and is open at either end, and wherein the process further comprises the step of:

closing off the groove at either end before the step of introducing the hardenable material.

* * * * *